US005509793A

United States Patent [19]

Cherry et al.

[11] Patent Number: 5,509,793

[45] Date of Patent: Apr. 23, 1996

[54] ROTARY DEVICE WITH SLIDABLE VANE SUPPORTS

[75] Inventors: Brian W. Cherry, Richmond, Canada; James E. Smith, Morgantown, W. Va.; Victor H. Mucino, Morgantown, W. Va.; Nigel N. Clark, Morgantown, W. Va.; Gregory Thompson, Morgantown, W. Va.; Patrick R. Badgley, Columbus, Ind.

[73] Assignee: Regi U.S., Inc., Richmond, Canada

[21] Appl. No.: 367,434

[22] Filed: Dec. 29, 1994

Related U.S. Application Data

[63] Continuation-in-part of Ser. No. 208,723, Feb. 25, 1994, Pat. No. 5,429,084.

[51] Int. Cl.[6] ..... F02B 53/00

[52] U.S. Cl. ..... 418/219; 418/230; 418/231; 418/137; 418/146; 123/243

[58] Field of Search ..... 418/137, 144, 418/146, 219, 228, 229, 230, 331; 277/81 P; 123/243

[56] References Cited

U.S. PATENT DOCUMENTS

| | | | |
|---|---|---|---|
| 570,584 | 11/1896 | White | 418/231 |
| 3,164,139 | 1/1965 | Appleton . | |
| 3,769,945 | 11/1973 | Kahre | 418/219 |
| 3,780,709 | 12/1973 | Williams . | |
| 3,819,309 | 6/1974 | Jacobs . | |
| 3,886,910 | 6/1975 | Vrooman | 418/219 |
| 3,942,484 | 9/1976 | Pile . | |
| 4,004,556 | 1/1977 | Pfeiffer . | |
| 4,170,213 | 10/1979 | Williams . | |
| 4,401,070 | 8/1983 | McCann . | |
| 4,492,541 | 1/1985 | Mallen-Herrero et al. | 418/219 |

*Primary Examiner*—Charles Freay

*Attorney, Agent, or Firm*—Shlesinger, Arkwright & Garvey

[57] ABSTRACT

An axial vane rotary device (14) includes a stator (16) with a cylindrical internal chamber (34) defined an annular outer wall (40) and two side walls (36, 38) of the stator. Each side wall has an annular cam surface (42, 44). A rotor (54) is rotatably mounted within the chamber. The rotor has an annular outer wall (66) and a plurality of angularly spaced-apart, axially extending slots (64) extending therethrough. A vane (68) is slidably received in each slot. The vanes reciprocate axially and alternatively expand and compress spaces between adjacent vanes and the cam sur-faces as the rotor rotates. The cam surfaces have alternating first portions (92) and second portions (90). The second portions are further from the rotor than the second portions. The first portions of one said cam surface are aligned with second portions of another said cam surface. The slots extend radially outwards on the rotor to the annular outer wall thereof. The outer edge of each vane slidably engages the annular outer wall of the stator. Each vane has an enlarged outer portion (75) slidably received in an enlarged outer portion (65) of one said slot (64).

12 Claims, 8 Drawing Sheets

ROTARY DEVICE WITH SLIDABLE VANE SUPPORTS

This application is a continuation-in-part of U.S. Ser. No. 08/208,723, filed Feb. 25, 1994, now U.S. Pat. No. 5,429, 084.

BACKGROUND OF THE INVENTION

1. Field of the Invention

This invention relates to rotary devices of the axial vane type, particularly the class of devices where volume change occurs between relatively close vanes and cam surfaces on each side of the rotor and where the vanes translate axially relative to the rotational axis of the rotor.

2. Description of Related Art

Many different types of rotary engines have been suggested in the past and have been covered by a large number of patents. Only a relatively small number of these have been thoroughly tested. Many rotary engines are appealing on paper, but practical difficulties arise when prototypes are constructed.

The best known rotary engine is the Wankel engine which is in volume production in Mazda automobiles. Even this engine has had considerable difficulties with proper sealing of the rotors, although such problems have been largely overcome.

Another type of rotary engine is referred to herein as the "axial vane type". This type of engine has a cylindrical rotor located within a cylindrical chamber in a stator. A plurality of blade-like vanes extend slidably through the rotor, parallel to the axis of rotation. There are undulating, parallel cam surfaces on each side of the rotor. High portions of the cam surface on one side align with low portions of the cam surface on the other side.

One such engine is found, for example, in U.S. Pat. No. 4,401,070 to James Lawrence McCann. This type of engine compresses gases forwardly of each vane in the direction of rotation as the rotor rotates. The compression occurs as the vane moves from a low cam surface, relatively distant from the rotor, to a high cam surface relatively close the rotor. After the gases are compressed, they must be transferred to the rearward side of each vane prior to combustion so that the ignited gases will propel the rotor forwards.

The need for transferring the compressed gases is removed in a variation of this type of rotary engine such as found in Polish Patent No. 38112 to Czyzewski. In this case, the gases are compressed between adjacent vanes which are angularly spaced-apart much closer than in the McCann engine. The gases are compressed as each pair of adjacent vanes moves towards a high cam area. Expansion of the ignited gases is permitted, and the propulsion force created, as the vanes continue to move past the high cam area to a relatively low cam area after ignition.

This type of rotary engine offers many potential advantages including high efficiency, simple construction and light weight. However, while the theoretical possibility of such an engine has been suggested in the past, many practical difficulties have inhibited development of these engines beyond the stage of a working prototype. For example, some earlier patents do not disclose any practical system of seals between the rotor, vanes and stator. In addition, relatively high loads can occur on the tips and seals of the vanes which can cause premature wear.

Accordingly it is an object of the invention to provide an improved axial vane rotary device which overcomes the disadvantages associated with earlier engines of the type.

It is another object of the invention to provide an improved axial vane rotary device with reduced loading on the side edges of the vanes where they ride on the cam surfaces of the stator.

It is yet another object of the invention to provide an improved axial vane rotary device with reduced loading on seals associated with the vanes.

It is a further object of the invention to provide an improved axial vane rotary device with a positive, efficient and durable sealing system.

It is a still further object of the invention to provide an improved axial vane rotary device which is practical to produce, relatively low in cost and durable.

SUMMARY OF THE INVENTION

In accordance with these objects, there is provided an axial vane rotary device including a stator with a cylindrical internal chamber defined by an annular outer wall and two side walls of the stator. Each side wall has an annular cam surface. A rotor is rotatably mounted within the chamber. The rotor has an annular outer wall and a plurality of angularly spaced-apart, axial slots extending therethrough. A vane is slidably received in each slot. Each vane has a radially outer edge, a radially inner edge and side edges. The side edges slidably engage the cam surfaces. There is first means for reciprocating the vanes axially and second means for alternatively expanding and compressing spaces between adjacent said vanes and the stator and the cam surfaces as the rotor rotates. The second means includes alternating first portions and second portions of the cam surfaces. The first portions are further from the rotor than the second portions. The first portions of one said cam surface are aligned with second portions of another said cam surface. Each slot has an enlarged outer portion and each said vane having an enlarged outer portion slidably received in the enlarged outer portion of one said slot.

Another aspect of the invention is characterized by the slots having narrower inner portions separated from the enlarged outer portions by shoulders on each side of each said slot.

The enlarged portion of each said vane preferably is adjacent the outer edge thereof.

The enlarged portion of each said vane may include two lateral extensions slidably received on the shoulders.

In one preferred embodiment each said vane has a projection on its inner edge slidably received in a transverse slot in the rotor.

DESCRIPTION OF THE PREFERRED EMBODIMENTS

Figure 3B:
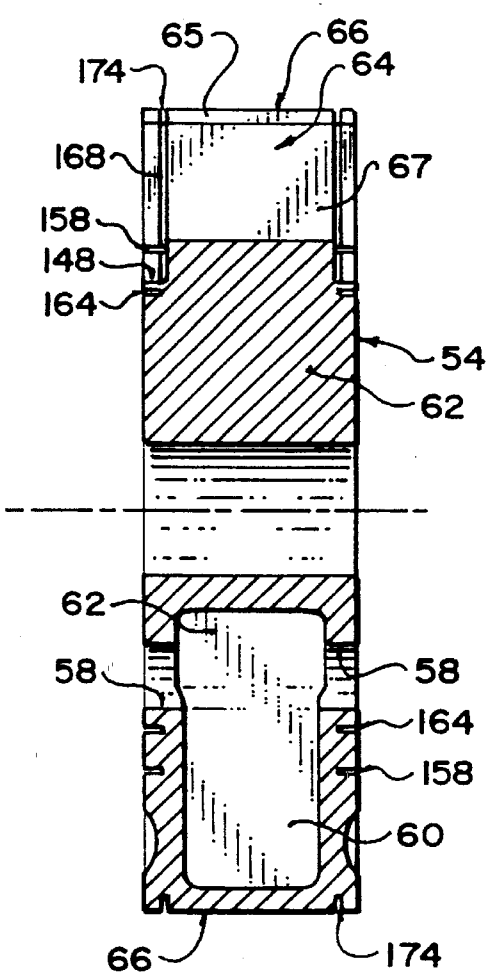
Figure 3A:
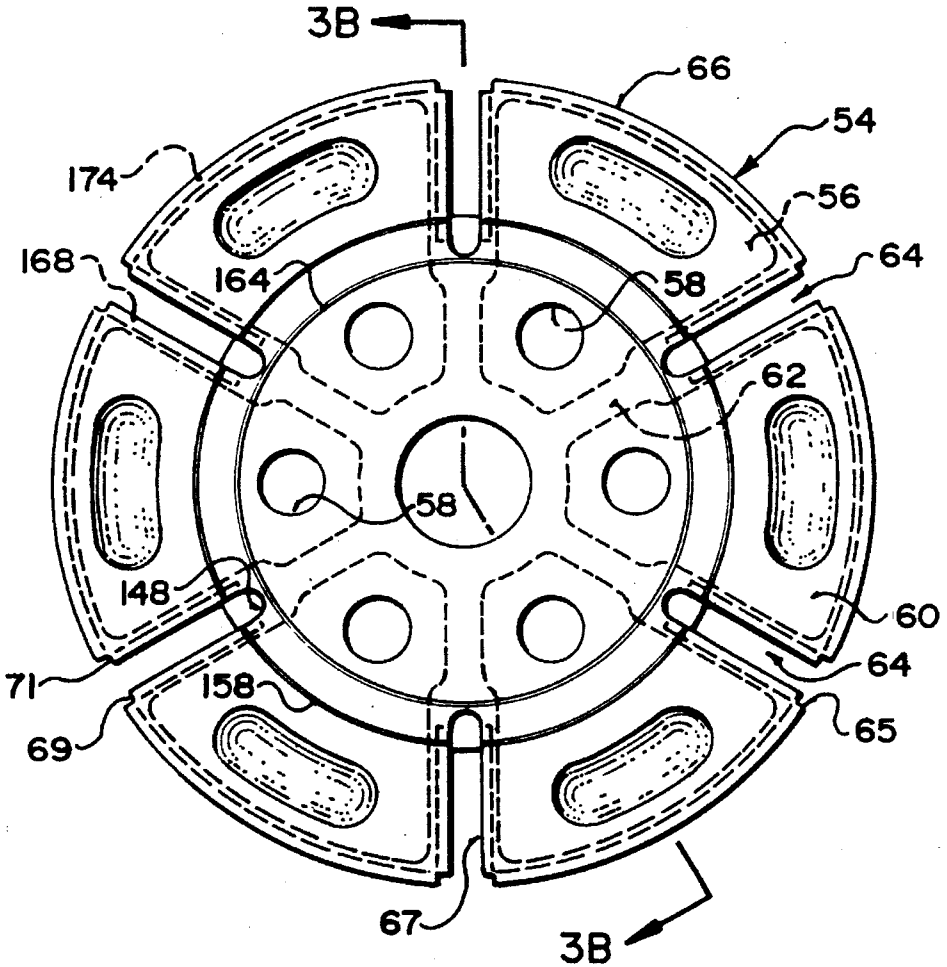

FIG. 3*a* is a side elevation of the rotor thereof;

FIG. 3*b* is a sectional view along line 3*b*—3*b* of FIG. 3*a;*

Figure 4:
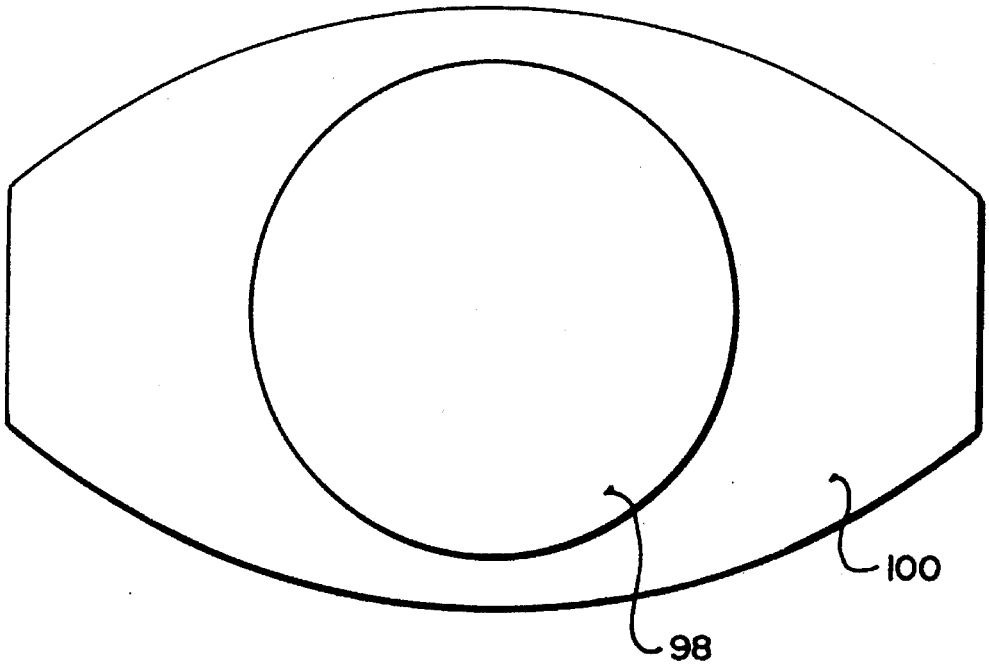
Figure 5:
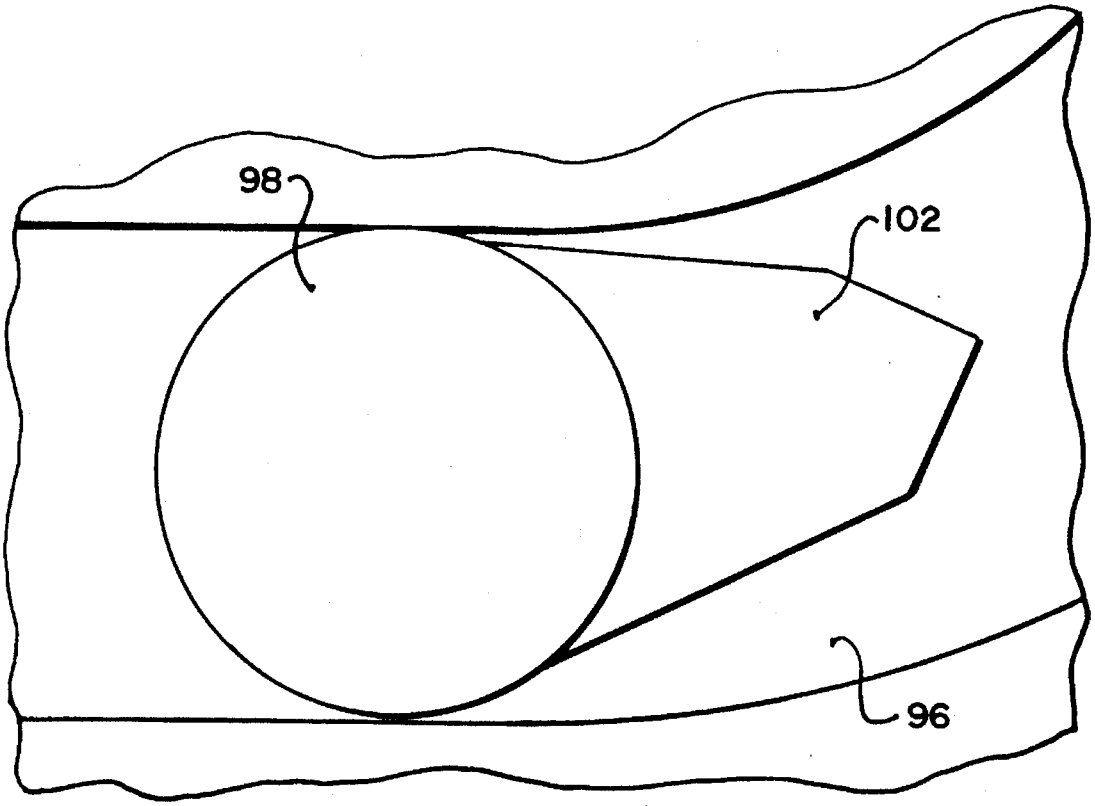
Figure 6:
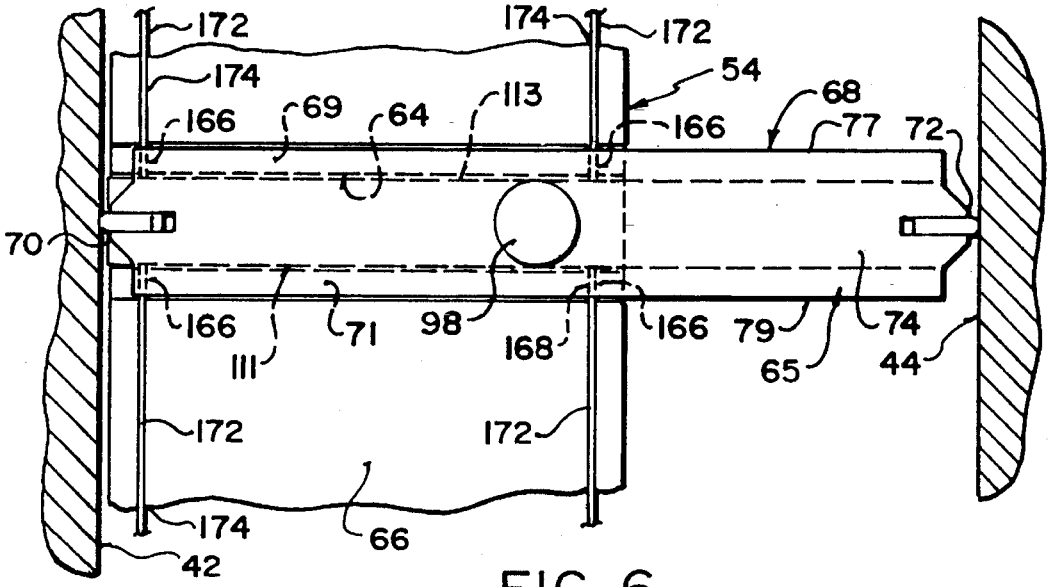
Figure 7:
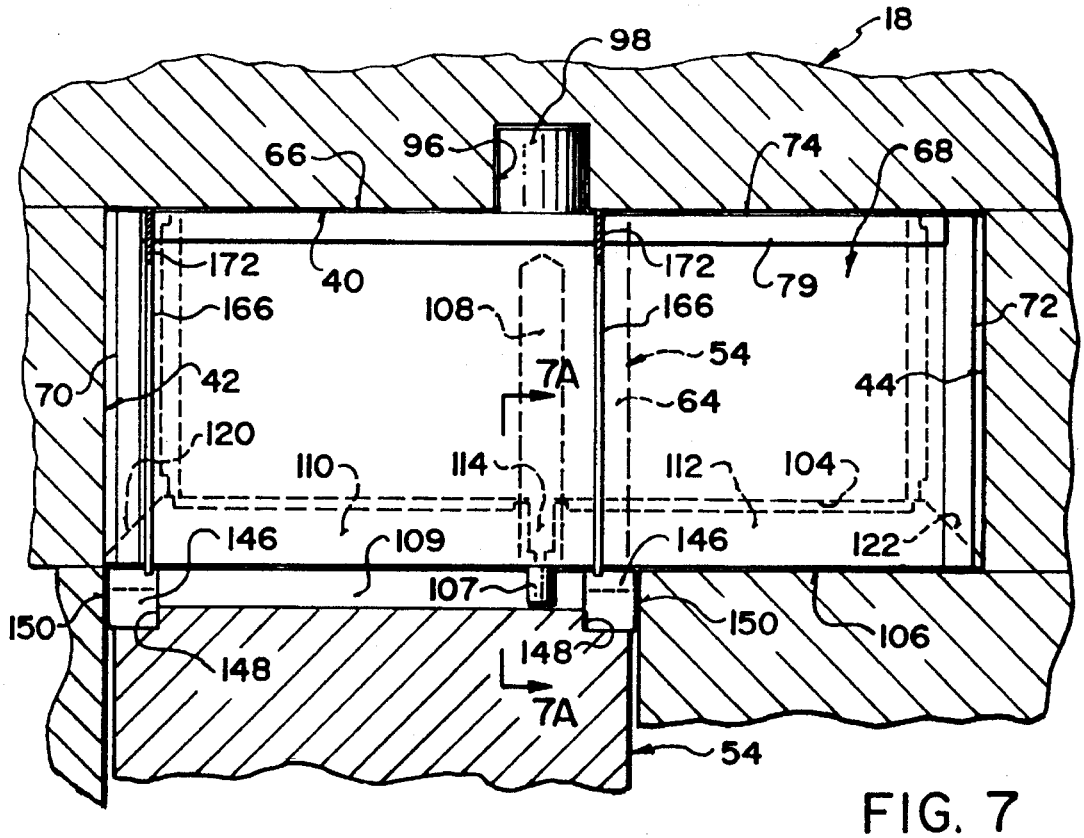
Figure 8A:
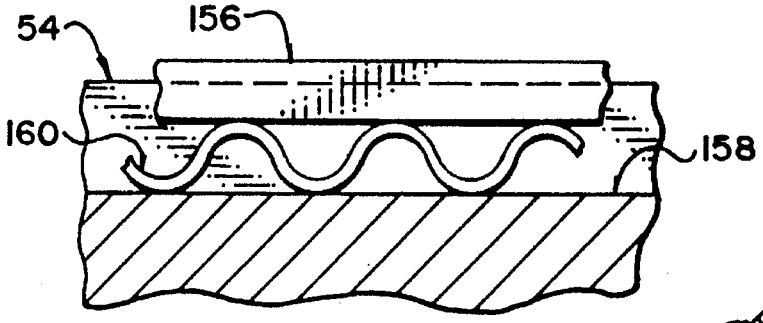
Figure 7A:
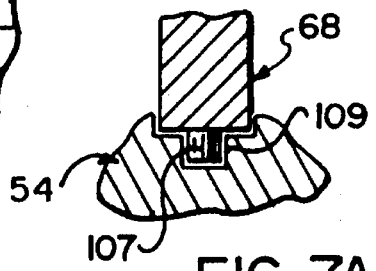
Figure 8:
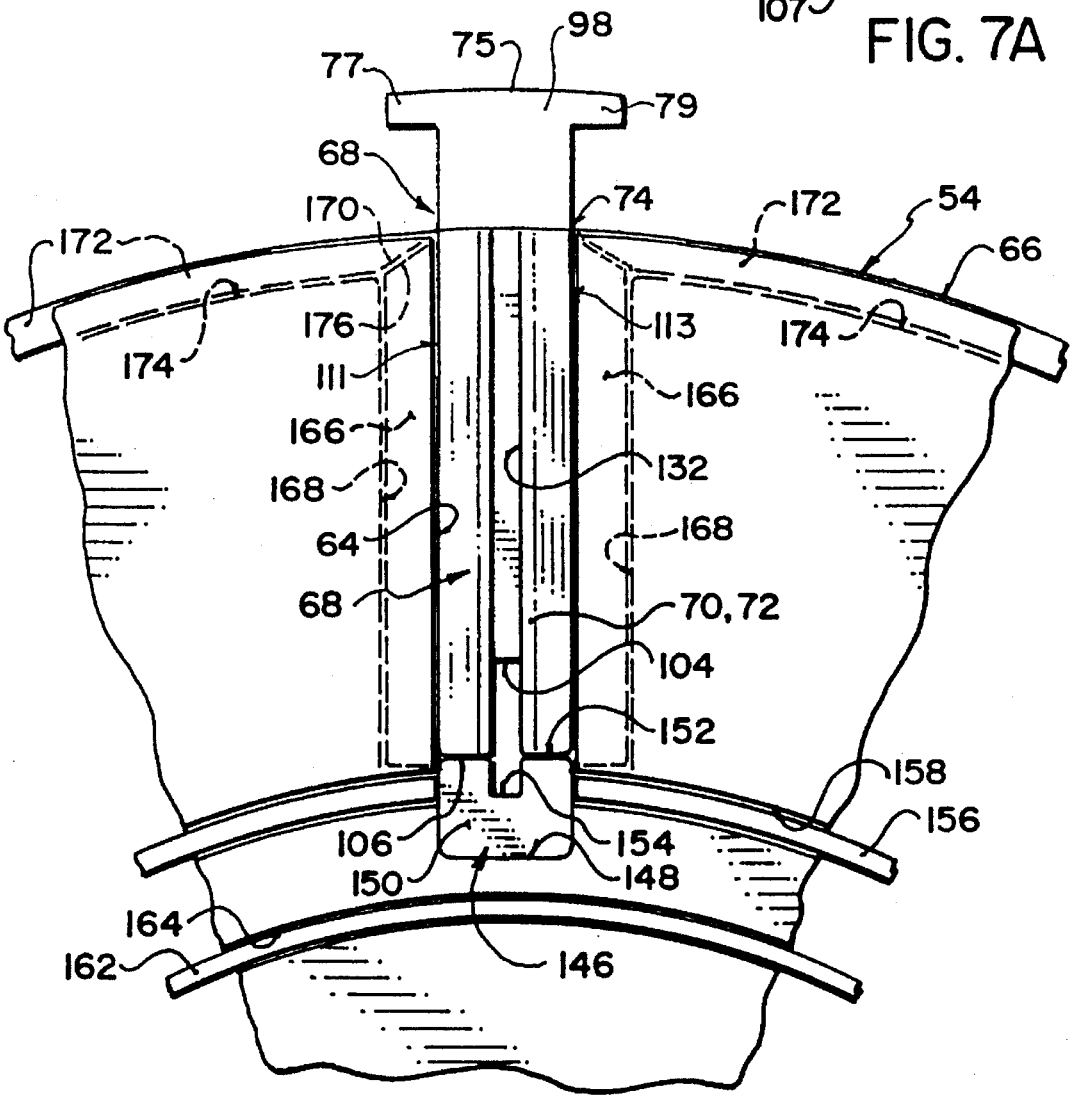
Figure 9:
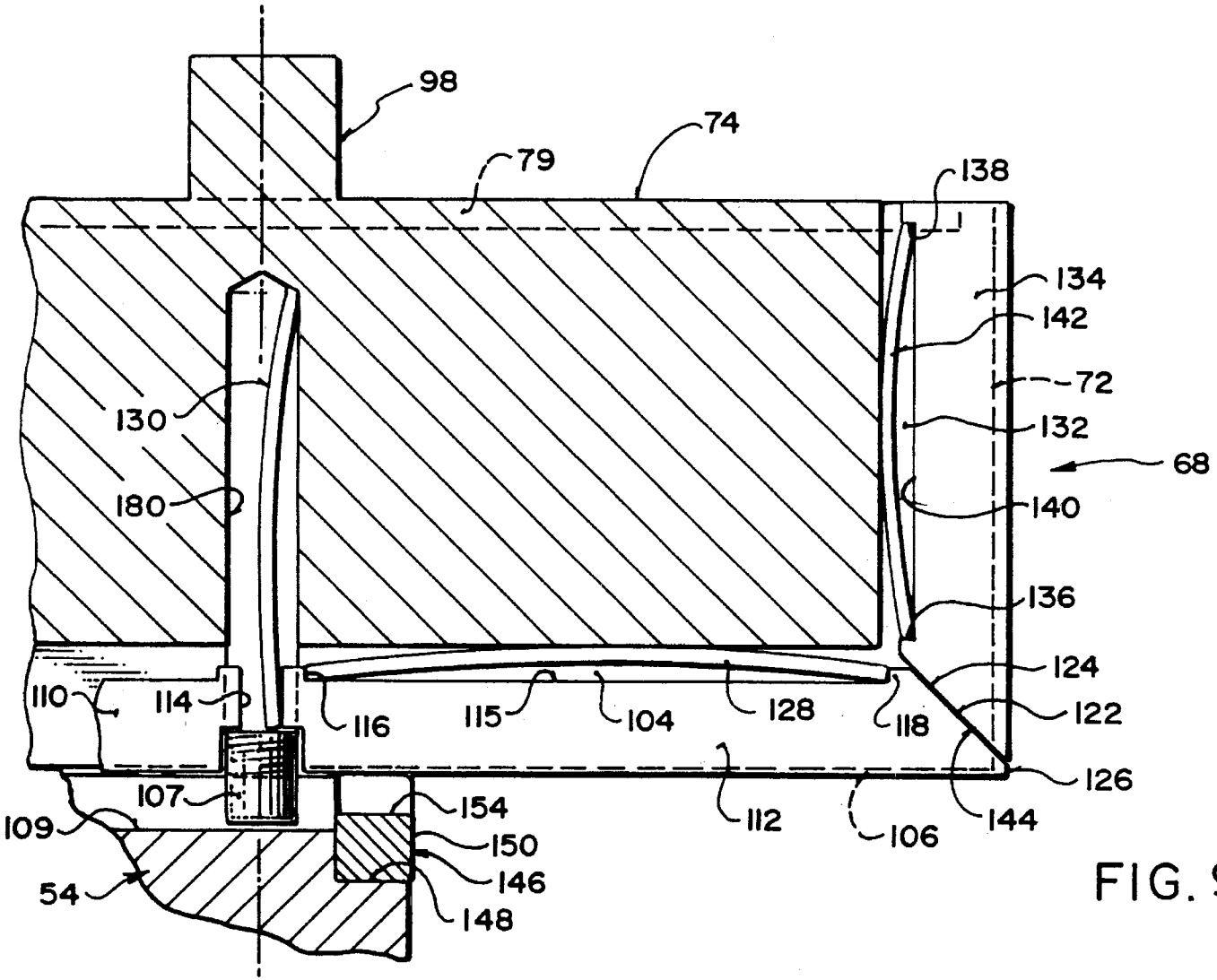
Figure 10:
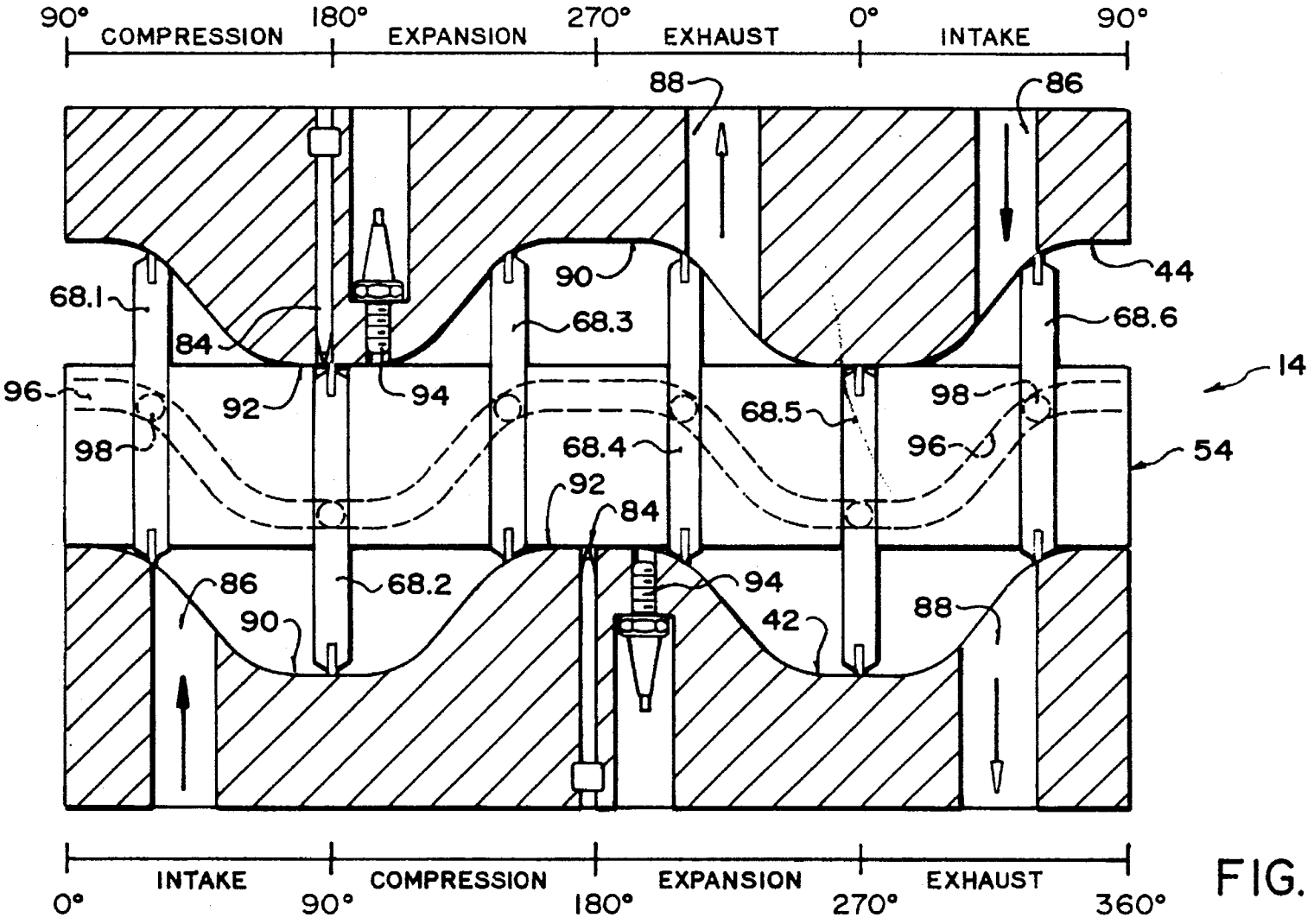

FIG. 4 is a simplified top plan view of the cam follower of one of the vanes of an alternative embodiment;

FIG. 5 is a top plan view of another cam follower with lubricated guide;

FIG. 6 is a top plan view of one of the vanes with associated seals;

FIG. 7 is a front view of one of the vanes, partly broken away and the rotor in fragment and showing the vane extending outwardly to the fight of the rotor;

FIG. 7*a* is a fragmentary section along line 7*a*—7*a* of FIG. 7;

FIG. 8 is a fragmentary side elevation of a portion of the rotor and one vane thereon;

FIG. 8*a* is an enlarged, fragmentary section of the rotor showing one of the seals thereof and the spring therefor;

FIG. 9 is an enlarged, fragmentary side elevation of one of the vanes with associated seals and springs for the seals showing the vane extending outwardly to the right of the rotor; and FIG. 10 is an unfolded geometrically developed view of the device for a six vane configuration.

DESCRIPTION OF THE PREFERRED EMBODIMENTS

Figure 1:
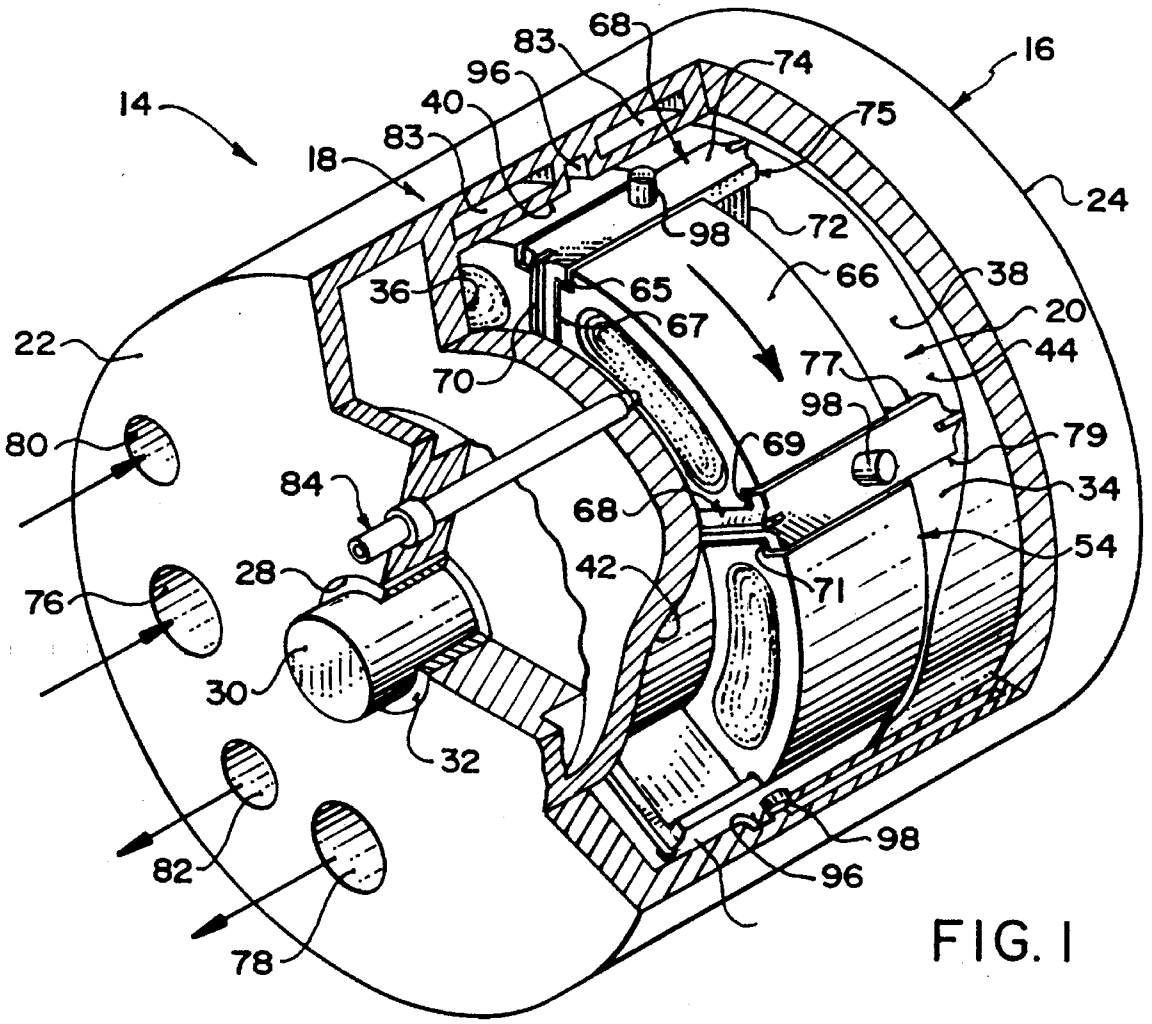
FIG. 1 is a simplified isometric view of an axial vane rotary device according to an embodiment of the invention with the stator thereof partly broken away.
Figure 2:
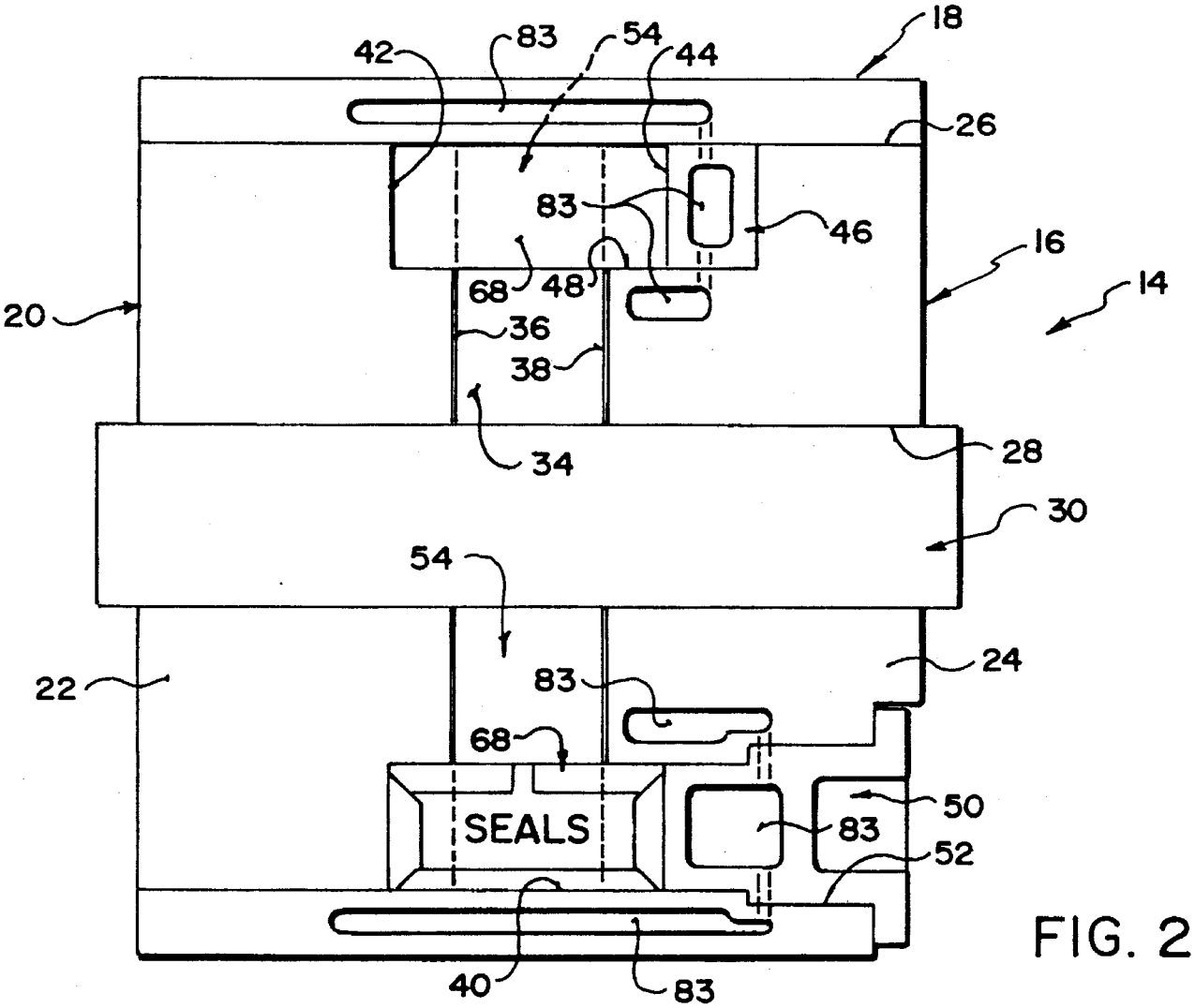
FIG. 2 is a simplified diametric section of the engine of FIG. 1.

Referring first to FIG. 1, this shows an axial vane rotary device which in this example is configured as an engine 14. The device could alternatively be configured as a compressor, pump or other such rotary device. The engine 14 has a stator 16 which includes a barrel-shaped outer housing 18. Various materials could be used including cast iron, but aluminum is preferred for weight and improved cooling. The stator also includes an inner housing 20 comprising a pair of annular members 22 and 24 in this example as shown in FIG. 2. Each member has an annular outer wall 26 fitting against the outer housing 18 and inner wall 28 rotatably supporting a shaft 30 by means of a bearing 32 on each side, one only being shown only in FIG. 1. There is a cylindrical internal chamber 34 within the stator defined by side walls 36 and 38 and annular outer wall 40.

The side walls 36 and 38 have radially outward portions thereof comprising cam surfaces 42 and 44 respectively. The cam surfaces in this embodiment form the inner surfaces of separate annular cam members. Two different types are shown in FIG. 2. At the top, right side of the engine is an internally installed cam member 46 which fits between outer housing 18 and shoulder 48 on annular member 24. There is a similar cam member on the opposite side of the engine (not shown). The outer housing 18 and inner housing 20 are one piece in this embodiment. An alternative type of cam member 50 is shown at the bottom fight side of the engine which is installed from the outside and fitted within an annular socket 52 in the member 24. The member 24, the cam member 50 and the housing 18 are separate in this form of the invention. It should be understood that only one type of cam member 46 or 50 would be used in any particular engine.

The cam surfaces 42 and 44 preferably are coated with a slurry type ceramic or cement coating to prevent wear and reduce friction. The cam members 46 and 50, shown in FIG. 2, require precise angular location between the two sides of the engine and the outer housing 18. Dowel pins or other devices are preferably used to give this alignment. This permits the cam surfaces to be separately positioned relative to the sides of the rotor to provide precise control of the gap between the side edges of the vanes and the cam surfaces 42 and 44.

Clearance can be provided between the cam surfaces and the inner housing 20 and outer housing 18. This clearance can be sealed with a pair of metallic circular seals and used to permit local thermal expansion of the cam surfaces.

A rotor 54, which is generally cylindrical in shape, is installed within chamber 34 and is rotatably supported by shaft 30. The rotor in this example is shown in better detail in FIG. 3*a* and 3*b* and is a hollow casting that is east using six pie shaped cores 56 that are used in the casting process to make the rotor hollow in the areas between the vanes and are supported by holes 58 in the side of the rotor. The outer portion 60 of the rotor can be hollow as illustrated or can be solid. There are support ribs 62 between the two sides of the rotor to reduce distortion caused by high gas pressure on the combustion chamber face of the rotor and/or thermal differences. These ribs may be shaped to channel oil either to the centre of the rotor or to outer wall 66 to enable the rotor to run essentially empty of oil to keep weight at a minimum. The rotor has a plurality of slots 64 which extend completely across the rotor and radially outwards to annular outer wall 66 thereof. This is a departure from prior art rotary engines of the type where the slots terminate inwardly from the annular outer wall. Each slot 64 has an enlarged outer portion 65 and a narrower inner portion 67 separated by shoulders 69 and 71 on each side of the slot as seen in FIG. 1.

Referring again to FIG. 1, a vane 68 is slidably received within each of the slots 64. The vanes are caused to reciprocate axially, in the direction parallel to shaft 30, as the rotor rotates. The vanes reciprocate back and forth and the seals thereof, described below, slidably engage undulating cam surfaces 42 and 44 as the rotor rotates. In this way, the engine is similar to previous engines of the type.

Engine 14 has vanes with radially outer edges 74 which slidingly engage outer wall 40 of the stator. This occurs because the slots 64 extend all the way out to the outer wall 66 of the rotor. The outer edge 74 of each vane is machined in this embodiment to match the outer wall 40 of the stator. In other words, the outer edge is slightly convex. This reduces crevice volume effects between the vane and outer housing which were present with some previous engines. A separate wear insert piece can be installed over the entire end of the outer edge of each vane to reduce friction and wear. The insert can be simply pressed into a slot in the vane.

In this embodiment, each vane has an enlarged portion 75 adjacent outer edge 74 thereof. This portion includes two lateral extensions 77 and 79 which are slidably received on the shoulders 69 and 71 of the rotor respectively. The extensions 77 and 79 and the shoulders provide support for each vane to resist forces acting on the outer edge 74. This removes stresses from inner edge 106 of each vane, shown in FIG. 7 and 8, and the seals thereof described below.

As shown in FIG. 7 and 7*a*, each vane 68 of this embodiment has a projection or pin 107 on its radially inner edge 106, the pin extending radially inwards. Each pin 107 is slidably received in a transverse slot 109 in the rotor 54. The pin and slot permit transverse reciprocation of each vane while providing support against forces acting against faces 111 and 113 of each vane shown in FIG. 6 and 8. The pin thus reduces forces on the vane seals described below. To reduce friction the pin may have an annular member rotatably received thereon.

As seen in FIG. 1, the engine 14 has provision for the intake of air at opening 76. Exhaust gases leave the engine through opening 78. Opening 80 admits cooling fluid into the engine, while opening 82 is for the discharge of coolant from the engine. There are passageways 83 in the stator which carry the coolant in order to cool the engine. The engine also has fuel injectors 85 which extend through the stator into the chamber 34, There is one fuel injector on each side of this engine, only one of which is seen in FIG. 1.

The operation of the engine is best understood with reference to FIG. 10. As may be seen, this particular engine has six vanes identified as 68.1–68.6 respectively. Each side of the engine operates essentially independently of the other side. Therefore, for explanation purposes, only the bottom half of the engine, from the point of view of FIG. 10, will be described. Rotor 54 rotates to the right of the drawing. Each side of the engine has an intake port 86 through the stator which communicates with the opening 76 shown in FIG. 1. Exhaust port 88 communicates with opening 78. The engine is described with reference to degrees of rotation about cam surface 42 starting with 0° at the left side of the drawing. Vane 68.1 is located at approximately 30°, just prior to intake port 86. As this vane continues to move forward, air received through intake port 86 is trapped between vanes 68.1 and 68.6. Vane 68.2 is shown at 90° at the compression stroke. The air between vane 68.2 and vane 68.3 is compressed due to the decreasing volume between the vanes as vane 68.2 moves from low cam portion 90 to high cam portion 92. The low cam portions are further from rotor 54 than the high cam portions.

The air between two vanes is fully compressed when they achieve the positions of vanes 68.3 and 68.4 where the two vanes are located over the high cam portion 92. Vane 68.3 is at a 150°, while vane 68.4 is at 210°. Ignition occurs in this example when the vanes are just past the positions shown and vane 68.3 is at about 150°. Expansion of the ignited mixture is permitted as the vane moves forwardly to the position of vane 68.5. This is the expansion stroke of the engine. The exhaust stroke begins at the position of vane 68.5 at 270° for this particular engine. At this point the exhaust gases are located between vane 68.5 and vane 68.6. The exhaust gases are forced out through exhaust port 88 as vane 68.5 moves forwardly, which is to the right from the point of view of the drawing. The other side of the engine operates in a similar manner, but the positions of the various strokes are staggered and follow the sequence of compression stroke, expansion stroke, exhaust stroke and intake stroke from left to tight from the point of view of FIG. 10.

In prior art engines of this type, reciprocation of the vanes with respect to the rotor was typically accomplished by the side edges of the vanes riding on the undulating cam surfaces as the rotor rotates. As may be seen in FIG. 10, high cam surfaces 92 on one side of the engine are located opposite low cam surfaces 90 on the other side of the engine.

Engine 14 however does not rely upon the cam surfaces to reciprocate the vanes. Instead, as seen in FIG. 1 and 10, the engine has means for reciprocating the vanes independently of the cam surfaces in the form of an undulating cam groove 96 extending about the outer wall 40 of chamber 34. The cam groove 96, also referred to as a guide cam, extends about the stator in an undulating pattern as best seen in FIG. 10. In this particular example, the groove is midway between the cam surfaces although this is not essential.

Each vane has a cam follower in the form of a pin 98 shown best in FIG. 1. The pin 98 of each vane is slightly smaller in diameter than the width of cam groove 96 so that the pins slidably follow along the groove as the rotor rotates. This may be appreciated from the different positions of the vanes shown in FIG. 10. The pins 98 cause the vanes to reciprocate axially as the rotor rotates.

Compared to prior art engines of the type mentioned above, the provision of a guide cam and follower, in the form of cam groove 96 and pins 98, means that the force to move the vanes is removed from the cam surfaces 42 and 44. Thus the strength of materials on the cam surfaces may be reduced so that lighter materials such as aluminum can be employed. In addition, liquid lubrication can be applied to the cam grooves and pins to reduce friction and wear. Previously the load had to be carried by the cam surfaces which had much more marginal lubrication and consequently higher rates of wear and fictional losses. The lubricant can be introduced into the cam groove, located on outer housing 18 of the stator, either through the rotor and drained out the through the outer housing or through the outer housing and drained out through other openings in the outer housing or back through the rotor. The cam groove can be machined directly into the outer housing, as in the illustrated embodiment of FIG. 1, or can be machined into an insert which is cast or otherwise attached to the inside of the outer housing. The cam groove may be coated with a wear resistant material if desired.

With reference to FIG. 4, this shows one of the pins 98 with a follower member 100 rotatably located thereon. The follower member is generally elliptical in this instance with truncated ends. The follower member is slidably received in groove 96.

Alternatively, separate loose members 102 can be attached to each pin 98 as shown in FIG. 5. These are loose parts used to guide the lubricant towards the sides of groove 96 to enhance the hydrodynamic load carrying capacity of the pins. In this instance the member 102 is pointed.

The illustrated pins 98 are cylindrical. However, other shapes are possible such as a truncated oval or other non-circular cross-sections adopted to optimize load carrying capacity.

Engine 14 has an improved sealing system compared with prior art engines of the type, as shown in FIG. 6–9. Each vane 68 has a slot 104 along radially inner edge 106 thereof. The groove extends between the side edges 70 and 72 with a break at the centre thereof formed by a bore 108 extending radially outwards from inner edge 106 to near the outer edge 74 of the vane. A pair of seals 110 and 112 are slidably received within the slot 104 and extend outwardly from the centre thereof to the side edges 70 and 72. The seals are generally rectangular. Each seal has a notch 114 at the end thereof adjacent the bore 108. In addition, longitudinal edge 115 within the slot 104 has shoulders 116 and 118 adjacent opposite ends thereof as seen in FIG. 9. The seals 110 and 112 have axially outer ends 120 and 122 respectively which are on ends opposite the notches 114. These outer ends include a radially outer portion 124, best seen in FIG. 9, which is bevelled at an acute angle with respect to the side edges of the vane. In this instance the outer portions are at an angle of 45° with respect to side edge 72 for example. However, this angle could be different. Each end also has a radially inner portion 126 which is parallel to side edge 72 and rests against the cam surface 44 shown in FIG. 1.

There is a leaf spring 128 located within slot 104 between each seal 110 and 112 and the vane. The leaf spring extends between shoulders 116 and 118 and resiliently biases each seal away from the slot 104 beyond inner edge 106 of the vane.

Each seal also has resilient means for biasing the seal axially outwards towards the cam surfaces. This is in the form of another leaf spring 130 received within the bore 108 and fitted against notch 114 of the seal. There is a similar spring for seal 110.

Each vane has a groove 132 extending along each side edge, such as shown for side edge 72 in FIG. 7. Another generally rectangular seal 134 is received slidably within the groove as seen in FIG. 9. The seal is similar in shape to the seals 110 and 112 and is provided with shoulders 136 (only one shown) on edge 140 which receives a leaf spring 142. The leaf spring biases the seal outwardly towards the adjacent cam surface and away from the vane. Each such seal has a radially inner end 144 which is bevelled, again at an angle of 45° in this instance with respect to side edge 72 of the vane. It may be seen that end 144 of seal 134 abuts radially outer portion 124 of seal 112 in sliding relationship. There is a similar seal 134 on the opposite side of the vane having a similar relationship with respect to seal 110. Each seal 134 is shorter than the height of the vane and cam surface to allow for the portion 126 of seals 110 and 112 which also ride on the cam surface. As the length of the cam height changes due to wear or thermal expansion, the seals 134 slide on the angled surfaces shared with seals 110 and 112 to fill up the resulting gap.

The seals 110, 112 and 134 can be made of a variety of materials such as monolithic silicone nitride, cast iron, ferrotic or Clevite 300. The seals are also arranged so that they are biased outwardly by gases compressed by the engine. The leaf springs serve to initially push the seals outwardly until the compressed gases are available during operation.

Block seals 146 are received within pockets 148 in each side of the rotor 54 as seen in FIG. 8. The block seals have outer face 150 which slidably contacts the inner housing surface. Each seal has a face 152 which slidably contacts inner edge 106 of the vane. The seals do not slide with the vane. There is a slot 154 which slidably receives the radially inner edge of one of the seals 110 and 112. Each of these seals is loaded against the vane by a combination of centrifugal force and an auxiliary spring. A simple cylindrical compression spring, for example, may be used to load each block seal against the vane. This may be retained in an aperture in the rotor. Another similar spring is used to load the outer seals against the inner housing surfaces. These springs are inserted into the face of the rotor.

The rotor also has a plurality of partially circular seals 156 received in arc-shaped grooves 158 on each side of the rotor between the block seals 146. In this embodiment these seals are rectangular in cross-section and made of iron or steel which are gas loaded with the assist of wave-shaped springs 160 within the slots 158 as shown in FIG. 8*a*. Gas sealing is accomplished by combustion pressure leaking around the seals into the spaces behind the seals as occurs with piston rings on conventional piston engines. The wave shaped springs are also used for seals 172, 166 and 162. As seen in FIG. 8, the ends of seals 156 are machined to abut against the block seals 146.

The rotor also has a circular seal 162 received within a circular groove 164 located radially inwards from seals 156. This provides additional protection from gas leakage and also prevents oil from leaking from the shaft bearings 32, shown in FIG. 1, into the combustion chambers. Another spring, similar to spring 160 in FIG. 8*a*, is used to preload this seal.

There are also rectangular section seals 166 received in grooves 168 on each side of each of the slots 64 in the rotor which receive the vanes as seen in FIG. 8. The grooves are radially extending and the seals are slidably: received in the grooves and biased towards each of the vanes 68 in the slot. Four such seals 166 are shown in FIG. 6. It may be seen that the radially outward end 170 of each of these seals is bevelled as shown in FIG. 8.

There are also a plurality of arc-shaped seals 172 received in grooves 174 in the outer wall 66 of the rotor extending between the vanes and seals 166 as seen in FIG. 8. These seals also have bevelled edges 176 which abut against edges 170 of the seals 166. The seals 172 are rectangular in section and are biased outwardly by wavy springs similar to springs 160 in FIG. 8*a*. Gas force keeps the seals biased outwardly along with centrifugal force once the engine is running. Like seals 166, the seals 172 can be installed as dual seals (a back-to-back pair per side) to provide additional sealing efficiency.

The engine described above is a compression ignition engine with a compression ratio between 14:1 and 22:1. Alternatively the invention is applicable to spark ignition engines and other rotary devices such as compressors or pumps.

It will be understood by someone skilled in the art that many of the details provided above are by way of example only and are not intended to limit the scope of the invention which is to be determined with reference to the following claims.

What is claimed is:

1. An axial vane rotary device (14) comprising a slater (16) with a cylindrical internal chamber (34) defined by an annular outer wall (40) and two side walls (36, 38) of the stator, each said side wall having an annular cam surface (42, 44); a rotor (54) rotatably mounted within the chamber, the rotor having an annular outer wall (66) and a plurality of angularly spaced-apart, axial slots (64) extending therethrough; a vane (68) slidably received in each said slot, each said vane having a radially outer edge (74), a radially inner edge (106) and side edges (70, 72), the side edges having members (134) slidably engaging the cam surfaces, each said vane having a projection (107) on its inner edge (106) slidably received in a transverse slot (109) in the rotor (54); first means (96, 98) for reciprocating the vanes axially; second means (42, 44) for alternatively expanding and compressing spaces between adjacent said vanes and the cam surfaces as the rotor rotates, said second means including alternating first portions (92) and second portions (90) on the cam surfaces, the second portions being further from the rotor than the first portions, the first portions of one said cam surface being aligned with the second ,portions of another said cam surface, the axial slots (64) extending radially outwards on the rotor to the annular outer wall (66) thereof and having enlarged outer portions (65), the outer edge (74) of each said vane slidably engaging the annular outer wall (40) of the stator, each said vane having an enlarged outer portion (75) slidably received in the enlarged outer portion (65) of one said axial slot (64).

2. A device as claimed in claim 1, wherein the axial slots have narrower inner portions (67) separated from the enlarged outer portions (65) by shoulders (69, 71) on each side of each said slot.

3. A device as claimed in claim 2, wherein the enlarged portion (75) of each said vane is adjacent the outer edge (74) thereof.

4. A device as claimed in claim 3, wherein the enlarged portion (75) of each said vane includes two lateral extensions (77, 79) slidably received on the shoulders (69, 71) respectively.

5. A device as claimed in claim 1, wherein the first means (96, 98) reciprocates the vanes independently of the cam surfaces, the first means including an undulating cam (96) extending about the outer wall of the stator and a cam follower (98) on the outer edge of each said vane.

6. A device as claimed in claim 5, wherein the undulating cam is a groove (96) and the follower is a pin (98) on the outer edge of each said vane.

7. An axial vane rotary device (14) of the type comprising a starer (16) with a cylindrical internal &amber (34) defined by an annular outer wall (40) and two side walls (36, 38) of the stator, each said side wall having an annular cam surface (42, 44); a rotor (54) rotatably mounted within the chamber, the rotor having an annular outer wall (66) and a plurality of angularly spaced-apart, axial slots (64) extending therethrough; a vane (68) slidably received in each said slot, each said vane having an outer edge (74) an inner edge (106) and side edges (70, 72), the side edges slidably engaging the cam surfaces, and a projection (107) on its inner edge (106) slidably received in a transverse slot (109) in the rotor (54); first means (96, 98) for reciprocating the vanes axially; and second means (42, 44) for alternatively expanding and compressing spaces between adjacent said vanes and the cam surfaces as the rotor rotates, said second means including alternating first portions (92) and second portions (90) on the cam surfaces, the second portions being further from the rotor than the first portions, the first portions of one said cam surface being aligned with the second portions of another said cam surface, each said axial slot (64) having an enlarged outer portion (65) and each said vane (68) having an enlarged outer portion (75) slidably received in the enlarged outer portion (65) of one said axial slot (64).

8. A device as claimed in claim 7, wherein the axial slots have narrower inner portions (67) separated from the enlarged outer portions (65) by shoulders (69, 71) on each side of each said slot.

9. A device as claimed in claim 8, wherein the enlarged portion (75) of each said vane is adjacent the outer edge (74) thereof.

10. A device as claimed in claim 9, wherein the enlarged portion (75) of each said vane includes two lateral extensions (77, 79) slidably received on the shoulders (69, 71) respectively.

11. An axial vane rotary device (14) comprising a stator (16) with a cylindrical internal chamber (34) defined by an annular outer wall (40) and two side walls (36, 38) of the stator, each said side wall having an annular cam surface (42, 44); a rotor (54) rotatably mounted within the chamber, the rotor having an annular outer wall (66) and a plurality of angularly spaced-apart, axial slots (64) extending therethrough; a vane (68) slidably received in each said slot, each said vane having a radially outer edge (74), a radially inner edge (106) and side edges (70, 72), the side edges having members (134) slidably engaging the cam surfaces, each said vane having first grooves (104, 132) along the inner edge (106) and side edges (70, 72) thereof, elongated seals (110, 112 and 134) being slidably received in the first grooves and biased away from said each vane, the rotor having a plurality of radially extending second grooves (168) on each side of each said slot (64), elongated seals (166) being slidably received in the second grooves and biased towards said vane in said each slot; first means (96, 98) for reciprocating the vanes axially; second means (42, 44) for alternatively expanding and compressing spaces between adjacent said vanes and the cam surfaces as the rotor rotates, said second means including alternating first portions (92) and second portions (90) on the cam surfaces, the second portions being further from the rotor than the first portions, the first portions of one said cam surface being aligned with the second portions of another said cam surface, the slots (64) extending radially outwards on the rotor to the annular outer wall (66) thereof and having enlarged outer portions (65), the outer edge (74) of each said vane slidably engaging the annular outer wall (40) of the starer, each said vane having an enlarged outer portion (75) slidably received in the enlarged outer portion (65) of on said slot (64).

12. A device as claimed in claim 11, wherein the annular outer wall (66) of the rotor has a plurality of circumferential third grooves (174), each said third groove having a plurality of curved seals (172) therein extending between the vanes and biased towards the outer wall of the stator.

* * * * *